US008544253B2

(12) United States Patent
Sevrette

(10) Patent No.: US 8,544,253 B2
(45) Date of Patent: Oct. 1, 2013

(54) DEVICE FOR INSERTING AND EXTRACTING CHAIN LINK PIVOT PINS

(76) Inventor: Jean Sevrette, Saint Aubin de Cretot (FR)

( * ) Notice: Subject to any disclaimer, the term of this patent is extended or adjusted under 35 U.S.C. 154(b) by 93 days.

(21) Appl. No.: 13/055,268

(22) PCT Filed: Jul. 16, 2009

(86) PCT No.: PCT/EP2009/059135

§ 371 (c)(1),
(2), (4) Date: Mar. 15, 2011

(87) PCT Pub. No.: WO2010/010035

PCT Pub. Date: Jan. 28, 2010

(65) Prior Publication Data

US 2011/0154799 A1 Jun. 30, 2011

(30) Foreign Application Priority Data

Jul. 22, 2008 (FR) ..... 08 54963

(51) Int. Cl.
*B23P 19/04* (2006.01)
*B25B 27/22* (2006.01)
*B21L 9/06* (2006.01)

(52) U.S. Cl.
USPC ..... 59/7; 59/11; 29/243.53; 269/43

(58) Field of Classification Search
USPC ..... 59/7, 8, 11, 35.1; 29/243.53; 269/43, 269/95, 104
See application file for complete search history.

(56) References Cited

U.S. PATENT DOCUMENTS 4,365,401 A * 12/1982 Ogren ..... 59/11
5,771,551 A * 6/1998 Schurter et al. ..... 29/243.54
6,951,096 B2 * 10/2005 Maguire et al. ..... 59/7

FOREIGN PATENT DOCUMENTS

FR 2902362 A1 12/2007

OTHER PUBLICATIONS

International Search Report, dated Nov. 16, 2009, from corresponding PCT application.

* cited by examiner

*Primary Examiner* — David B Jones
(74) *Attorney, Agent, or Firm* — Young & Thompson

(57) ABSTRACT

A device (10) for the on-site fitting and extraction of pivot pins of large chain links, which include an alternating sequence of external links and internal links, each internal link including two parallel side pieces pierced at their ends, joined together at the ends by a tubular spacer, and articulated at the ends of the side pieces of the internal links on the pierced ends of the parallel side pieces of two consecutive external links via pivot pins, of the type which includes at least one cylinder (44) which is intended to selectively stress a pivot pin or a side piece of an external link in order to insert the pin or extract the pin, characterized in that it includes a pair of portable cylinder supports (46), supporting two pivoting cylinders (44), synchronized in displacement, and a control device (48) common to both cylinders (44).

15 Claims, 4 Drawing Sheets

DEVICE FOR INSERTING AND EXTRACTING CHAIN LINK PIVOT PINS

Figure 1:
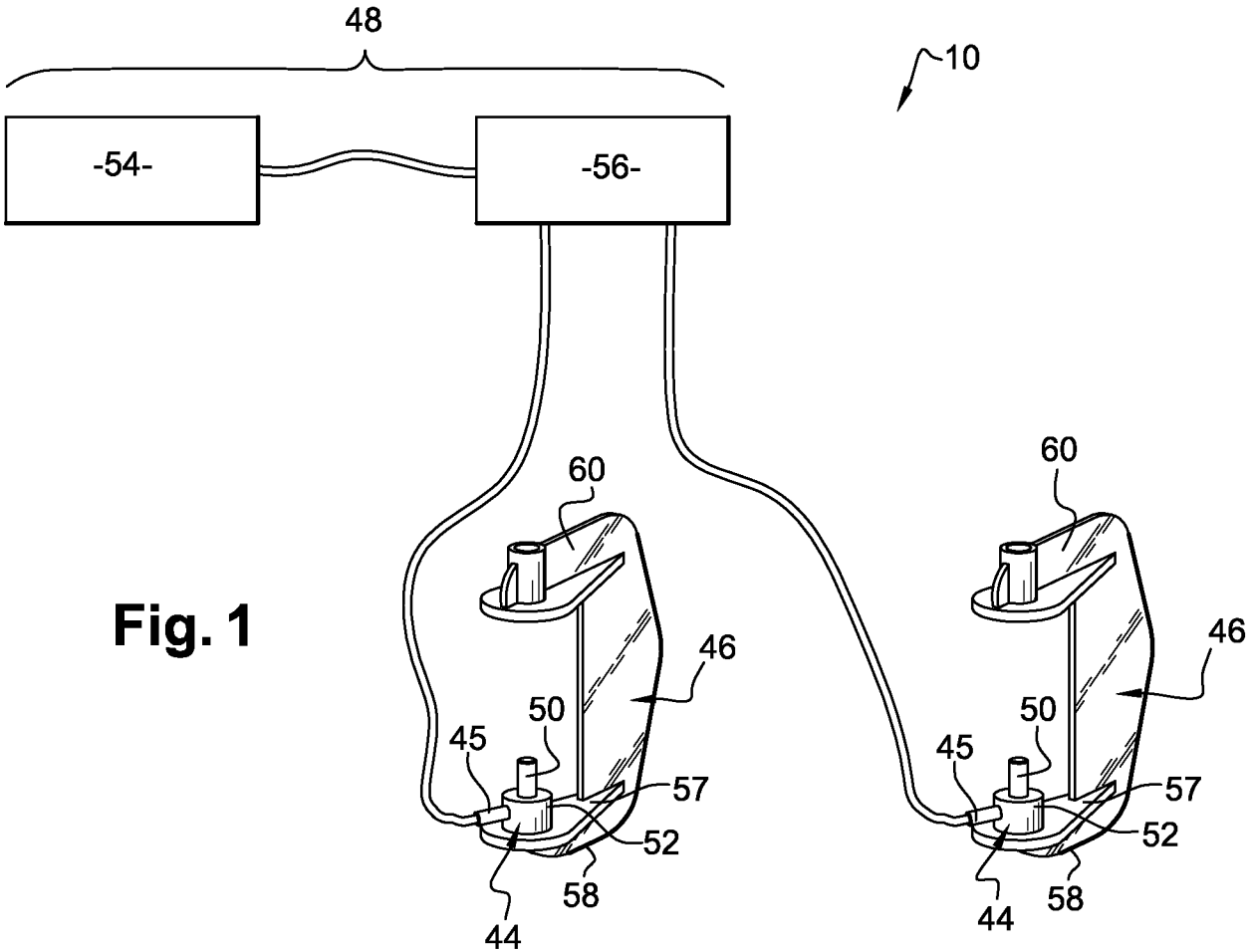

The invention relates to a device for the on-site fitting and extraction of pivot pins of large chain links, notably of chains of cement works conveyors.

The invention relates more particularly to a device for the on-site fitting and extraction of pivot pins of large chain links, notably of chains of cement works conveyors, which comprise an alternating sequence of so-called external links and so-called internal links, each internal link comprising at least two parallel side pieces pierced at their ends, joined together at said ends by a tubular spacer, and articulated at said ends of the parallel side pieces of the internal links on the pierced ends of the parallel side pieces of two consecutive external links via associated pivot pins, said device comprising at least one cylinder which comprises:

at least one pair of portable cylinder supports, likely to be fitted on site by an operator at the opposite ends of an external link, two hydraulic cylinders synchronized in displacement, each of which is received in one of the supports and is intended to selectively stress an associated pivot pin or else the ends of a side piece of an associated external link to which the associated support is fitted to push the associated pivot pin through at least one end piercing of the associated external link, the aligned end piercings of the associated internal link, and the associated spacer, to simultaneously insert or extract the pins associated with the two cylinders.

The document FR-2.902.362 describes and represents such a device, which is used for the on-site assembly or maintenance of chains with large links.

In practice, such chains are commonly used in heavy industry, notably for the transmission of movement within large conveyors. The size and weight of the links of this type of chain, typically of the order of thirty or so kilograms per link, limits their displacement.

This device makes it possible to carry out, on site, large chain link maintenance operations, and makes it possible to limit both the fatigue of the operators and the risk of accidents during link mounting or dismantling operations.

However, this device cannot be used systematically given that the hydraulic cylinders that it employs are conventionally mounted fixed relative to the portable cylinder supports.

In this configuration, the hydraulic cylinder feed ducts are necessarily fixed, and may, depending on the configurations of use, come up against an obstacle arranged close to the chain to be dismantled, which may prevent the fitting of the portable cylinder supports on the chain.

The invention remedies this drawback by providing a refinement of the invention that is the subject of the application FR-2.902.362, by making it possible to orient the hydraulic feed ducts of the cylinders.

To this end, the invention proposes a device of the type described previously, characterized in that each hydraulic cylinder comprises a rod which is moved by a hydraulic piston mounted to move in a tubular body which is fed via an associated duct, and in that said body is mounted to pivot axially relative to the associated cylinder support to allow a selective orientation of the duct according to the space available around each portable cylinder support.

According to other characteristics of the invention:

each support comprises a first branch which is intended to be arranged at the end of a side piece of the external link of the chain and which transversally receives a cylinder to selectively stress the side piece of the external link or else the pivot pin, and a second branch, parallel to the first branch, which is intended to form an abutment element opposing the movement of at least one element out of the side pieces of the internal or external links, the spacer or the pivot pin, in order to:

drive the two external side pieces, the two internal side pieces and the spacer onto the pivot pin when the cylinder stresses the side piece of an external link and when the second branch opposes the movement of the pivot pin, or else extract the pivot pin when the cylinder stresses the pivot pin and when the second branch opposes the movement of at least one element out of the side pieces of the internal or external links and the spacer by allowing the passage of the pin through the elements, the movement of which it does not oppose, the body of each cylinder comprises a pin, which extends opposite the rod from the body of said cylinder, which passes through a piercing of a transversal wall of the first branch, which is mounted to pivot relative to said piercing, and which is axially immobilized relative to the first branch, the pin is axially immobilized and mounted to pivot relative to the first branch via a ball thrust bearing, notably single-acting, which is received on the pin in contact with the transversal wall of the first branch, and which is stressed against said transversal wall via a compression spring which is threaded onto the pin, and notably centred on said pin via tapered rings, and which is secured to a threaded end of the pin by at least one lock nut, each support is in the form of a stirrup comprising a transversal joining branch connecting two parallel branches which are intended to be arranged on either side of the external link, the first branch of which comprises the cylinder, the rod of which is likely to receive at its end a support element of a diameter corresponding to that of the pivot pin or else a tubular support element of an internal diameter greater than that of the pivot pin, and the second branch of which comprises a bore of a diameter greater than that of the pivot pin which is likely to receive a tubular bottom bush, the bottom piercing of which is of a diameter corresponding to that of the pivot pin, in order to selectively:

extract the pivot pin, the rod of the cylinder (44) receiving at its end the support element of the diameter corresponding to that of the pivot pin and the bore of the second branch not containing the tubular bush, or else drive the two external side pieces, the two internal side pieces and the spacer onto the pivot pin, the rod of the cylinder receiving at its end the tubular support element of the internal diameter greater than that of the pivot pin intended to bear on the external side piece of the associated link, and the bore of the second branch receiving the tubular bottom bush intended to immobilize the pivot pin and the side piece of the external link opposite the cylinder, the two parallel branches are made of the same material as the transversal joining branch, the transversal joining branch supports at least one transversally adjustable bracket, a first branch of which is fixed to the transversal joining branch, and a protruding second branch of which comprises an abutment key which faces towards the internal side of the side piece of the external link opposite the cylinder, which is intended to allow said side piece to be pinched between the branch of the bracket and the second branch of the support, the adjustable bracket comprises:

at least two screws which pass through the first transversal branch and which are likely to be received in two tappings of a series of tappings (84) formed in the transversal branch of the support at a spacing corresponding to that of the screws of the branch of the bracket, to offer several positions of the bracket relative to the transversal branch, at least one transversal stop screw, which passes through a tapping formed in the second branch projecting from the bracket, and the end of which comprises the abutment key, to allow an accurate adjustment of the position of the abutment key, each support comprises two parallel flanges forming the first and second branches, joined together at an adjustable distance by at least one pair of tie rods, a first flange comprising the cylinder, the rod of which is likely to receive at its end a support element of a diameter corresponding to that of the pivot pin or else a tubular support element of an internal diameter greater than that of the pivot pin, and a second flange, comprising, on the one hand, a bore of a diameter corresponding to that of the spacer and, on the other hand, consisting of two dismantleable half-flanges abutting in a plane passing through a diameter of said bore, said bore being likely to selectively receive a tubular bottom bush, the bottom piercing of which is of a diameter corresponding to that of the pivot pin, in order to selectively:

extract the pivot pin, the rod of the cylinder of the first flange receiving at its end the support element of the diameter corresponding to that of the pivot pin and the second flange occupying a transversal position on the tie rods such that the second flange is assembled around the spacer received in the bush-free bore of said second flange, or else drive the two external side pieces, the two internal side pieces and the spacer onto the pivot pin, the rod of the cylinder receiving at its end the tubular support element (66) of the internal diameter greater than that of the pivot pin intended to bear on the external side piece of the associated link, and the second flange occupying a transversal position on the tie rods such that the flanges are arranged on either side of the side pieces of the external link, the bore of the second flange receiving the tubular bottom bush intended to immobilize the pivot pin and the side piece of the external link opposite the cylinder, the ducts are fed with hydraulic fluid via a single hydraulic feed element, the control device common to both cylinders comprises the single hydraulic feed element and a hydraulic distributor which is intended to distribute the hydraulic fluid obtained from the single hydraulic feed element between the ducts of the two cylinders to provoke the simultaneous displacement of the two cylinders, the hydraulic distributor comprises two independent manual valves that can be used to adjust the flow rate of hydraulic fluid feeding each cylinder to manually synchronize the displacements of the two cylinders, the hydraulic distributor is an automatic distributor that makes it possible to automatically synchronize the displacement of the two cylinders in a synchronized manner, the hydraulic feed element consists of an electrically-powered hydraulic plant.

Figure 2:
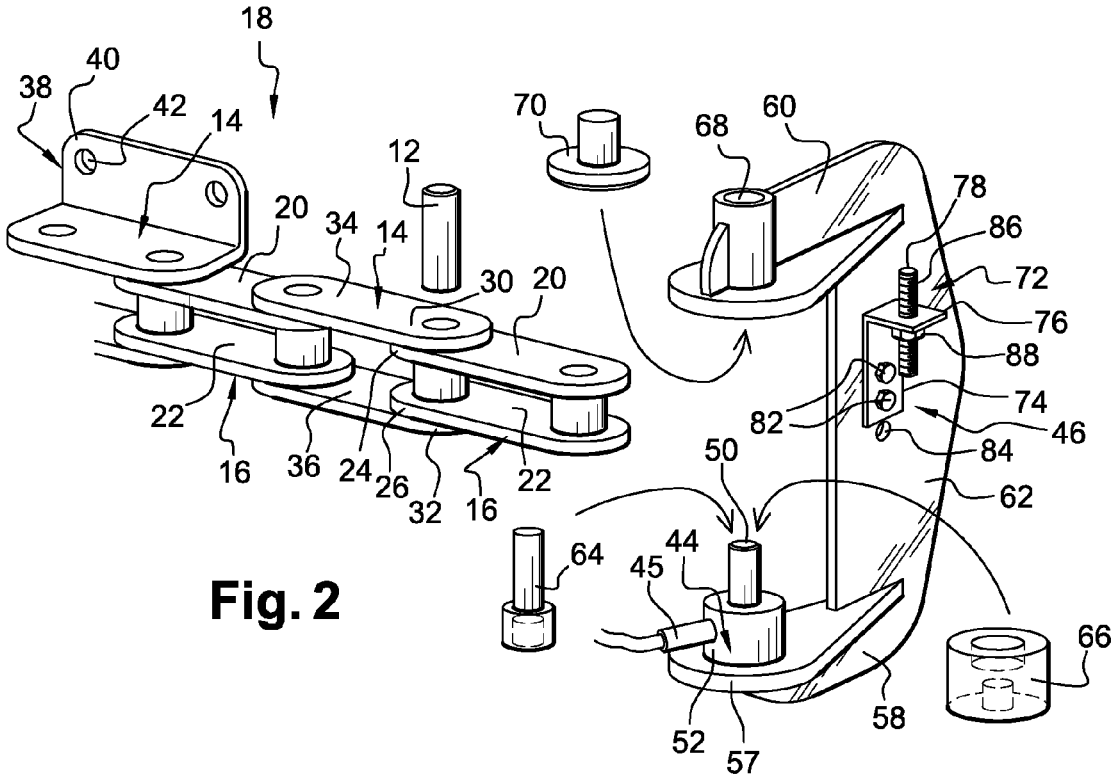
Figure 3:
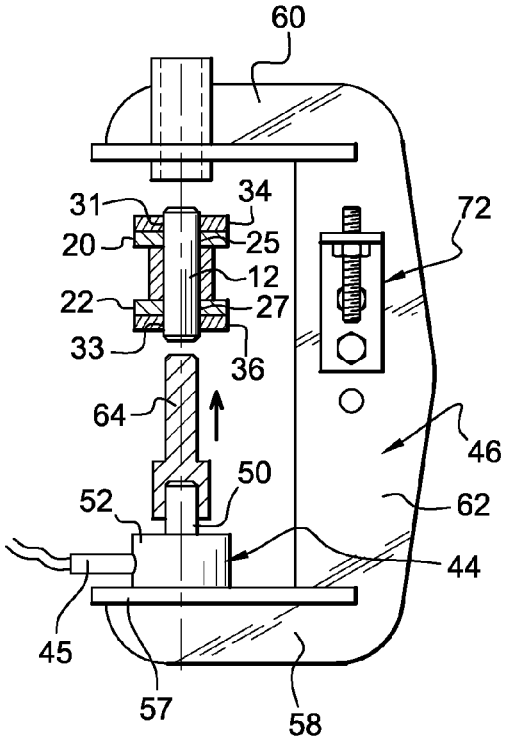
Figure 4:
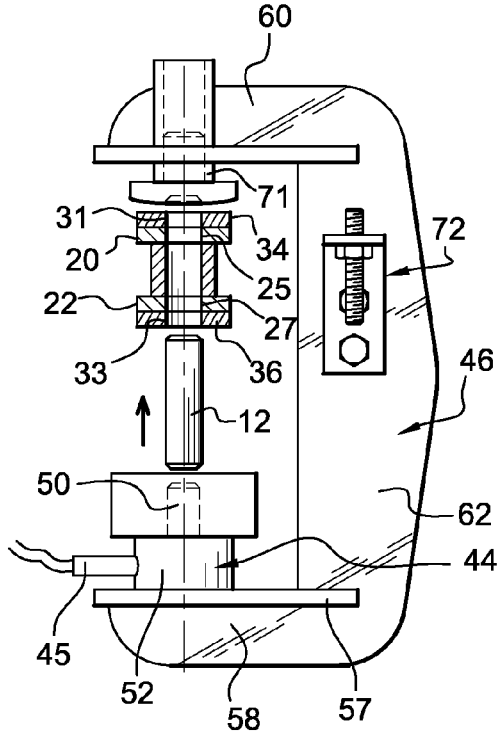
Figure 5:
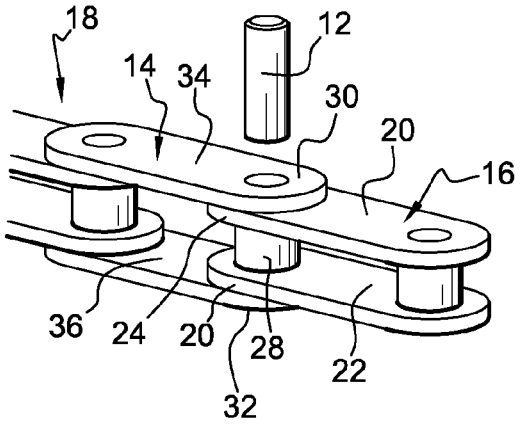
Figure 5:
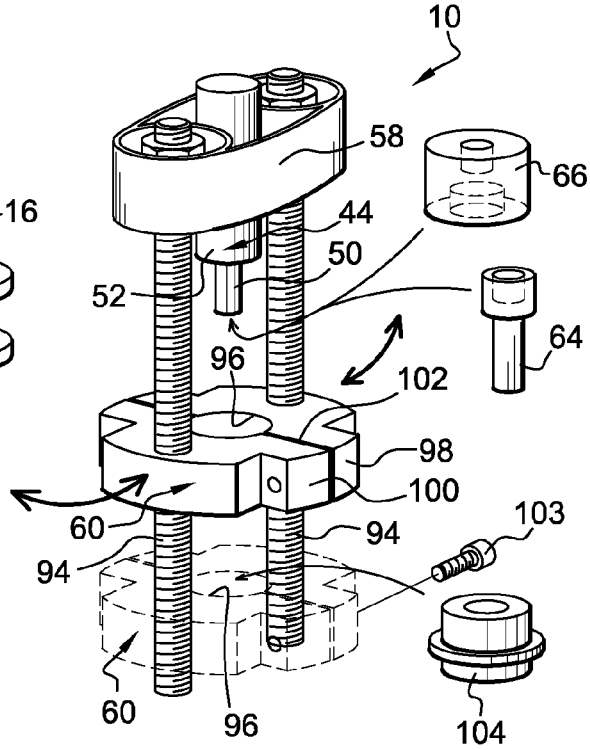
Figure 6:
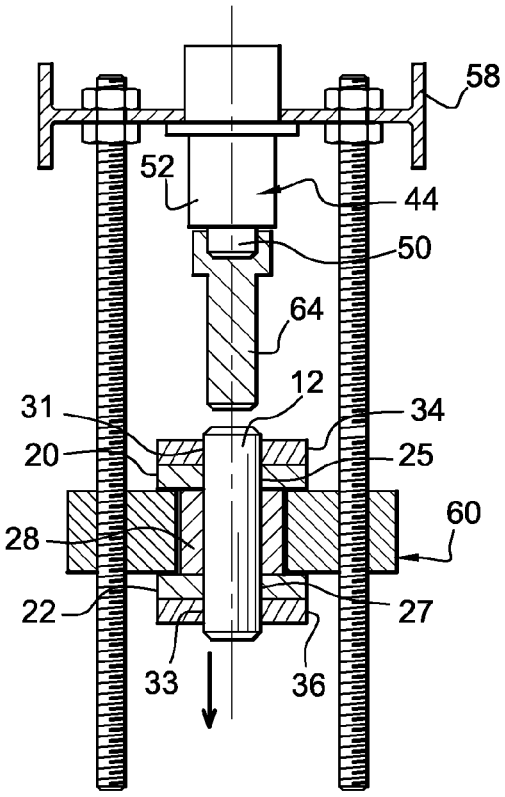
Figure 7:
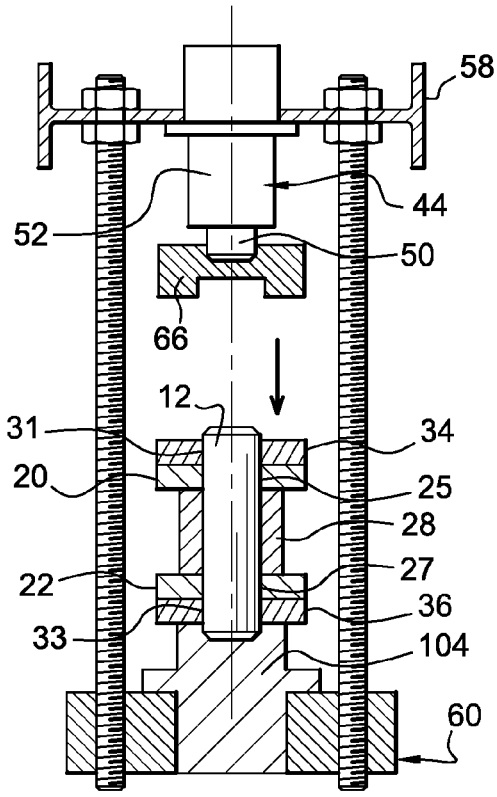
Figure 8:
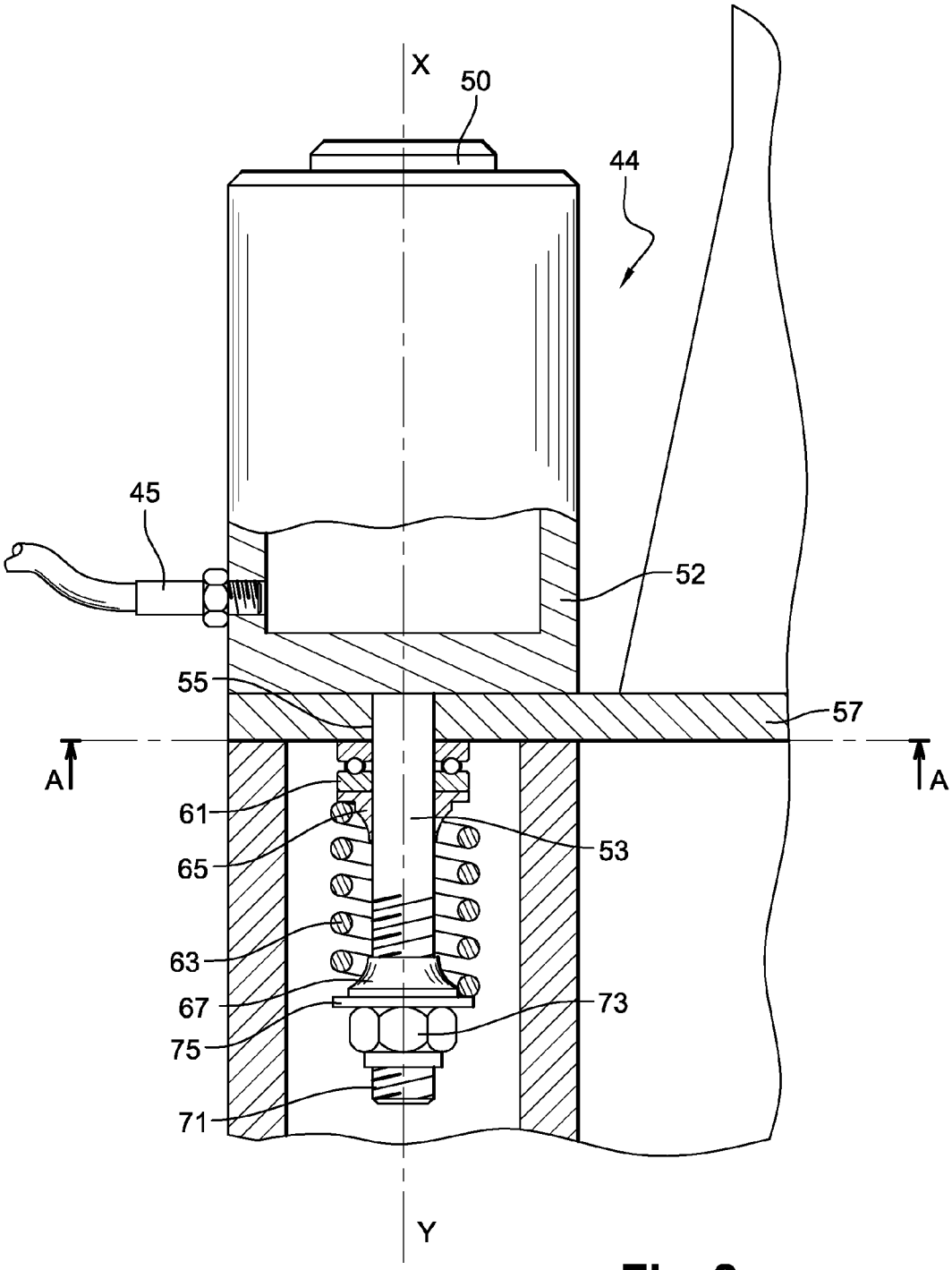

Other features and advantages of the invention will become apparent upon reading the following detailed description, for an understanding of which reference should be made to the appended drawings in which:

FIG. 1 is a perspective schematic view of a device according to the invention, FIG. 2 is a perspective view of a cylinder support according to a first embodiment of the invention, FIG. 3 is a cross-sectional view of the cylinder support of FIG. 2 represented during an operation to extract a chain link pin, FIG. 4 is a cross-sectional view of the cylinder support of FIG. 2 represented during an operation to insert a chain link pin, FIG. 5 is a perspective view of a cylinder support according to a second embodiment of the invention, FIG. 6 is a cross-sectional view of the cylinder support of FIG. 5 represented during an operation to extract a chain link pin, FIG. 7 is a cross-sectional view of the cylinder support of FIG. 5 represented during an operation to insert a chain link pin, FIG. 8 is a detail cross-sectional view illustrating the mounting of a cylinder in the cylinder support of FIG. 2.

In the following description, identical reference numerals designate identical parts or parts that have similar functions.

FIGS. 1, 2 and 5 show a device 10 for the on-site fitting and extraction of pivot pins 12 of links 14, 16 of large chains 18, notably of cement works conveyor chains.

Such chains 18 comprise, in a known manner, an alternating sequence of so-called external links 14 and so-called internal links 16, each internal link 16 comprising at least two parallel side pieces 20, 22 pierced at their ends 24, 26, joined together at said ends 24, 26 by a tubular spacer 28, and articulated at said ends 24, 26 of the parallel side pieces 20, 22 of the internal links 16 on the pierced ends 30, 32 of the parallel side pieces 34, 36 of two consecutive external links 14 via associated pivot pins 12.

In particular, as FIGS. 3, 4, 6 and 7 illustrate, the ends 24, 26 of the parallel side pieces 20, 22 of the internal links 16 are passed through by associated piercings 25, 27, and the ends 30, 32 of the parallel side pieces 34, 36 of the external links 14 are passed through by associated piercings 31, 33.

As an example, in the case of cement works conveyors, two parallel chains support a series of evenly-spaced bins (not represented), and each bin is therefore fixed at its opposite ends to a chain of the type of the chain 18. To this end, as illustrated in FIG. 2, depending on the spacing of the bins along its associated parallel chains 18, one of the two side pieces 34 of certain external links 16 constitutes a branch of a angle iron 38, the other branch 40 of which is used to fix one end of the bin (not represented).

The branch 40 is fixed to the bin (not represented) via screws (not represented) passing through piercings 42 of the branch 40 of the angle iron.

As is known, the device 10 comprises at least one cylinder 44 which is intended to selectively stress a pivot pin 12 or a side piece 32 of an external link 14 in order to respectively push a pivot pin 12 through at least one end piercing 31 and/or 33 of an external link 14, the aligned end piercings 25, 27 of an internal link 16, and the associated spacer 28, in order to insert said pin 12 or extract said pin 12.

More particularly, the invention proposes, in a known manner, a device 10 of the type described previously that can be used portably in order to allow interventions on site.

The device 10 thus comprises:

at least one pair of portable cylinder supports 46, likely to be fitted on site, by an operator, to the opposite ends of an external link 14, two hydraulic cylinders 44, synchronized in displacement, each of which is intended to be received in one of the supports 46, and which are intended to simultaneously stress the pivot pins 12 or else the ends of the side piece 32 of the external link 14 on which the support 46 is fitted, to push the associated pivot pin 12 through at least one end piercing 31, 33 of the associated external link 14, the aligned end piercings 25, 27 of the associated internal link 16, and the associated spacer 28.

The device 10 thus makes it possible to simultaneously insert or extract the pins 12 associated with the two cylinders 44.

However, in its simplest definition, this device cannot be used systematically given that the hydraulic cylinders 44 that it employs are conventionally fixed relative to the portable cylinder supports.

In practice, as illustrated in FIGS. 1 to 4, each hydraulic cylinder 44 comprises a rod 50 which is moved by a hydraulic piston (not represented) mounted to move in a tubular body 52 which is fed via an associated lateral duct 45.

In this configuration, the lateral hydraulic cylinder feed ducts 45 are necessarily fixed, and may, depending on the configurations of use, encounter an obstacle arranged close to the chain to be dismantled, which may prevent the fitting of the portable cylinder supports 46 on the chain.

The invention remedies this drawback by proposing a device 10 whose design makes it possible to orient the hydraulic feed ducts 45 of the cylinders 44.

To this end, according to the invention, and as illustrated more particularly in FIG. 8, the body 52 is mounted to pivot axially relative to the associated cylinder support 46 in order to allow a selective orientation of the duct 45 according to the space available around each portable cylinder support 46.

Two embodiments of the invention will now be described below in the present description.

In each of these two embodiments, and generally, each support 46 comprises a first branch 58 which is intended to be arranged at the end of a side piece 32 of the external link 14 of the chain and which transversally receives a cylinder 44 in order to selectively stress the side piece 32 of the external link 14 or else the pivot pin 12, and a second branch 60, parallel to the first branch 58, which is intended to form an abutment element opposing the movement of at least one element out of the side pieces 24, 26, or 30, 32 of the internal 16 or external 14 links, the spacer 28 or the pivot pin 12.

This configuration allows, depending on choice:

either the two external side pieces 30, 32, the two internal side pieces 24, 26 and the spacer 28 to be driven onto the pivot pin 12 when the cylinder 44 stresses the side piece 32 of an external link 14 and when the second branch 60 opposes the movement of the pivot pin 12, or, on the other hand, the pivot pin 12 to be extracted when the cylinder 44 stresses the pivot pin 12 and when the second branch 60 opposes the movement of at least one element out of the side pieces of the internal 16 or external 14 links and the spacer 28, while allowing the passage of the pin 12 through the elements, the movement of which it does not oppose.

Starting from this general operating principle, as illustrated in FIG. 8, the body 52 of each cylinder 44 comprises a pin 53, which extends opposite the rod 50 from the body 52 of said cylinder 44, which passes through a piercing 55 in a transversal wall 57 of the first branch 58. This pin 53 is mounted to pivot relative to said piercing 55, and it is axially immobilized relative to the first branch 58.

More particularly, the pin 53 is immobilized axially and mounted to pivot relative to the first branch 58 via a ball thrust bearing 61. This thrust bearing is, for example, and in a manner that does not limit the invention, a single-acting thrust bearing 61.

The thrust bearing 61 is received on the pin in contact with the transversal wall 57 of the first branch, and it is stressed against said transversal wall 57 via a compression spring 63 which is threaded onto the pin 53.

The spring 63 is preferably centred on the pin 53 via tapered rings 65, 67 mounted at its ends, and it is nevertheless secured to a threaded end 71 of the pin 53 via at least one lock nut 73 and an associated washer 75.

The use of a lock nut 73 advantageously makes it possible to adjust the preloading of the spring 63 and therefore determine the intensity of the manual torque which has to be exerted on the body 53 of the cylinder 44 to cause it to rotate.

This configuration, which has been represented in FIG. 8 for a support 46 similar to that of FIGS. 1 to 4, nevertheless is applicable to both embodiments of the invention described hereinafter in the present description.

According to a first embodiment which has been represented in FIGS. 1 to 3, each support 46 is in the form of a stirrup comprising a transversal joining branch 62 connecting two parallel branches 58, 60 which are intended to be arranged on either side of the external link 14.

The first branch 58 comprising the cylinder 44, the rod 50 of which is likely to receive at its end a support element 64 of a diameter corresponding to that of the pivot pin or else a tubular support element 66 of an internal diameter greater than that of the pivot pin 12, and the second branch 60 comprises a bore 68 of a diameter greater than that of the pivot pin 12 which is likely to receive a tubular bottom bush 70, the bottom piercing 71 of which is of a diameter corresponding to that of the pivot pin 12.

This first configuration makes it possible to selectively extract the pivot pin 12, as represented in FIG. 3.

To this end, the rod 50 of the cylinder 44 receives at its end the support element 64 of the diameter corresponding to that of the pivot pin 12 and the bore 68 of the second branch 60 contains no tubular bush.

This first configuration also makes it possible to drive the pivot pin 12, as represented in FIG. 2, or to be more precise, drive the two external side pieces 30, 32, the two internal side pieces 24, 26 and the spacer 28 onto the pivot pin 12, the rod 50 of the cylinder 44 receiving at its end the tubular support element 66 of the internal diameter greater than that of the pivot pin 12, which is then intended to bear on the external side piece 32 of the associated link 14, and the bore 68 of the second branch receiving the tubular bottom bush 70 intended to immobilize the pivot pin 12 and the side piece 30 of the external link 14 which is opposite the cylinder 44.

It should be noted that this configuration can also be applied in particular to pins 12 that include a flat on the side of the side piece 30, pins that consequently cannot pass through said side piece 30. In this case, the concept of "driving" the side piece 30 cannot strictly be used since the latter is already firmly attached to the end of the pin 12.

Preferably, in this first embodiment, the two parallel branches 58, 60 are made of the same material as the transversal joining branch 62. The three branches may be produced by assembling and welding steel elements, or by forming an alloy that can be formed by a foundry method, such as casting.

Advantageously, the transversal joining branch 62 supports at least one transversally adjustable bracket 72, a first branch 74 of which is fixed to the transversal joining branch 62, and a protruding second branch 76 of which comprises an abutment key 78 which faces towards the internal side 80 of the side piece 30 of the external link 14 opposite the cylinder 44. This key 78 is intended to enable said side piece 30 to be clamped between the branch 76 of the bracket and the second branch 60 of the support.

In order to be able to be adapted to different thicknesses of link side pieces, the adjustable bracket 72 comprises:

at least two screws 82 which pass through the first branch 62 and which are likely to be received in two tappings of a series of tappings 84 formed in the transversal branch 62 of the support 46 at a spacing corresponding to that of the screws 82 of the branch 74 of the bracket 72, to offer several positions of the bracket 72 relative to the transversal branch 62, at least one transversal stop screw 86, which passes through a tapping formed in the second branch 76 protruding from the bracket 72, and the end of which comprises the abutment key 78, to allow an accurate adjustment of the position of the abutment key 78. It will be noted that the screw 86 can be immobilized relative to the second branch 76 of the bracket 72 by a lock nut 88.

According to a second embodiment of the invention represented in FIGS. 4 to 7, each support 46 comprises two parallel flanges 58, 60 joined together at a spacing that can be adjusted by at least one pair of tie rods 94.

A first flange 58 comprises the cylinder 44, the rod 50 of which is likely to receive at its end a support element 64 of a diameter corresponding to that of the pivot pin 12 or else a tubular support element 66 of an internal diameter greater than that of the pivot pin 12.

A second flange 60 comprises on the one hand a bore 96 of a diameter corresponding to that of the spacer and on the other hand consists of two dismantleable half-flanges 98, 100 abutting in a plane 102 passing through a diameter of said bore 96. This bore 96 is likely to selectively receive a tubular bottom bush 104, the bottom piercing of which is of a diameter corresponding to that of the pivot pin 12. The two half-flanges 98, 100 can be assembled together by screws 103 or by any other assembly means known in the state of the art.

In this configuration, the device 10 can be used, as illustrated in FIG. 6, to extract the pivot pin 12.

During this operation, the rod 50 of the cylinder 44 of the first flange 58 receives at its end the support element 64 of the diameter corresponding to that of the pivot pin 12 and the second flange 60 occupies a transversal position on the tie rods 94 such that the second flange 60 is assembled around the spacer 28 received in the bush-free bore 96 of said second flange 60. The pin 12 can then be driven through the second flange 60 and the spacer 28.

The device 10 according to this second embodiment can also be used, as illustrated in FIG. 7, to drive the two external side pieces 30, 32, the two internal side pieces 24, 26 and the spacer 28 onto the pivot pin 12, the rod 50 of the cylinder 44 receiving at its end the tubular support element 66 of the internal diameter greater than that of the pivot pin 12 intended to bear on the external side piece 32 of the associated link, and the second flange 60 occupying a retracted transversal position on the tie rods 94 such that the flanges 58, 60 are arranged on either side of the side pieces 30, 32 of the external link 14. The bore 96 of the second flange 60 then receives the tubular bottom bush 104 which is intended to immobilize the pivot pin 12 and the side piece 30 of the external link 14 opposite the cylinder 44.

It should be noted that this configuration can also be applied in particular to pins 12 that include a flat on the side of the side piece 30, pins that cannot consequently pass through said side piece 30. In this case, the concept of "driving" the side piece 30 cannot strictly be used, since the latter is already firmly attached to the end of the pin 12.

In the two preferred embodiments of the invention, the bodies 52 of the cylinders 44 are fed with hydraulic fluid via lateral ducts 45 which are in turn fed by a single hydraulic feed element 54.

Any hydraulic feed element 54 known in the state of the art can be used for the correct implementation of the invention. The hydraulic feed element 54 may notably consist of a manual pump actuated by the operator of the device 10. However, in the interests of ease of use, and in order to minimize the fatigue of the operator, the hydraulic feed element 54 preferably consists of an electrically-powered hydraulic plant.

This offers the notable advantage of being easy to carry and of being able to supply a high hydraulic power suitable for activating the cylinders 44.

As illustrated in FIG. 1, the control device 48 common to both cylinders comprises the single hydraulic feed element 54 and a hydraulic distributor 56 which is intended to distribute the hydraulic fluid obtained from the single hydraulic feed element 54 between the ducts 45 of the two cylinders 44 to provoke the simultaneous displacement of said cylinders 44. It is in fact essential to the correct operation of the device 10 for advance of the rods of the cylinders 44 to be simultaneous in order to provoke a satisfactory driving of the side pieces 32 of the external link 14 onto the pins 12 or to provoke a satisfactory extraction of the pins 12.

The hydraulic distributor 56 can be produced simply and economically using two independent manual valves used to regulate the flow of hydraulic fluid feeding each cylinder 44 in order to manually synchronize the displacements of the two cylinders 44.

Preferably, the hydraulic distributor 56 is an automatic distributor that can be used to automatically synchronize the displacement of the rods 50 of the two cylinders 44 in a synchronized manner.

The invention therefore advantageously makes it possible to assemble or separate internal 14 and external 16 links of a large chain, without risk and without fatigue for the operator carrying out this operation.

The invention claimed is:

1. A device (10) for on-site fitting and extraction of pivot pins (12) of chain links (14, 16) which comprise an alternating sequence of external links (14) and internal links (16), each external link (14) comprising parallel side pieces (34, 26) with pierced ends (30, 32) having corresponding end piercings (31, 33), each internal link (16) comprising two parallel side pieces (20, 22) with pierced ends (24, 26) having corresponding end piercings (25, 27), a tubular spacer (28) joining together the parallel side pieces of the external links and the parallel side pieces of the internal links at the pierced ends of the parallel side pieces of the external links and at the pierced ends of the parallel side pieces) the internal links, the external links and the internal links being articulated at said pierced ends of the parallel side pieces of the external links and the parallel side pieces the internal links via associated pivot pins (12), said device (10) comprising:

i) a pair of portable cylinder supports (46), fittable on-site by an operator at the pierced ends of a first of said external links (14);

ii) two hydraulic cylinders (44) synchronized in displacement, each of the said hydraulic cylinders (44) received in a respective one of the supports (46), each of the said hydraulic cylinders (44) arranged to selectively stress i) an associated one of the pivot pins (12) of said first external link or ii) one of the parallel side pieces (32) of said first external link (14), the stress being sufficient to push the associated one pivot pin (12) through one of the end piercings (31, 33) of said first external link (14), together with aligned end piercings (25, 27) of an associated one of the internal links (16), and an associated one of the spacers (28), to simultaneously insert or extract the pins (12) associated with the pierced ends of said first external link (14);

iii) a control device (48) common to the two cylinders (44); and iv) a pair of lateral ducts (450, each lateral duct (45) connecting the control device to a corresponding one of the hydraulic cylinders, wherein each hydraulic cylinder (44) comprises a tubular body (52) with a movable hydraulic piston connected to a corresponding one the lateral ducts (45), a rod (50) moved by movement of the hydraulic piston, and wherein each said tubular body (52) is mounted to pivot axially relative to the associated cylinder support to allow a selective orientation of the corresponding one lateral duct according to space available around the associated cylinder support.

2. The device according to claim 1, wherein, each cylinder support (46) comprises i) a first branch (58) which transversally receives said cylinder (44), and ii) a second branch (60), parallel to the first branch (58), the second branch (60) forming an abutment element opposing movement, in order to drive the two external parallel side pieces, the two internal parallel side pieces and the spacer (28) onto the pivot pin (12) when the cylinder (44) stresses the one side piece (32) of the first external link (14).

3. The device according to claim 2, wherein, the body (52) of each cylinder (44) comprises a pin (53), which extends, opposite the rod, from the body of said cylinder, which pin is mounted to pivot relative to said piercing, and which pin is axially immobilized relative to the first branch.

4. The device according to claim 3, wherein, the pin is axially immobilized and mounted to pivot relative to the first branch via a ball thrust bearing, and tapered rings are secured to a threaded end of the pin by at least one lock nut.

5. The device (10) according to claim 2, wherein, each support (46) defines a stirrup comprising a transversal joining branch (62) connecting two parallel branches (58, 60) which are arrangeable on either side of the first external link (14), the first branch (58) of the two parallel branches comprising the cylinder (44), the rod (50), and the second branch (60) of the two parallel branches comprising a bore (68) of a diameter greater than a diameter of the pivot pin (12) to receive a tubular bottom bush (70) with a bottom piercing (71) of a diameter corresponding to the diameter of the pivot pin (12), in order to selectively:

extract the pivot pin, and drive the two external side pieces (30, 32), the two internal side pieces (24, 26) and the spacer (28) onto the pivot pin (12).

6. The device (10) according to claim 5, wherein the two parallel branches (58, 60) are made of the same material as the transversal joining branch (62).

7. The device (10) according to claim 6, wherein the transversal joining branch (62) supports at least one transversally adjustable bracket (72) with a first branch (74) fixed to the transversal joining branch (62), and with a protruding second branch (76) comprising an abutment key (78) which faces towards an internal side (80) of the side piece of the first external link (14) opposite the cylinder (44), allowing said side piece to be clamped between the branch (76) of the bracket (72) and the second branch (60) of the support.

8. The device (10) according to claim 7, wherein the adjustable bracket (72) comprises:

at least two screws (82) which pass through the first transversal branch (62) and which are to be received in two tappings (84) of a series of tappings (84) formed in the transversal branch (62) of the support at a spacing corresponding to that of the screws (82) of the branch (74) of the bracket (72), to offer plural positions of the bracket (72) relative to the transversal branch (62), and at least one transversal stop screw (86), which passes through a tapping formed in the second branch (76) projecting from the bracket (72), and the end of which comprises the abutment key (78), to allow an accurate adjustment of the position of the abutment key (78).

9. The device (10) according to, claim 2 wherein each support (46) comprises two parallel flanges (58, 60) forming the first and second branches, joined together at an adjustable distance by at least one pair of tie rods (94), a first flange (58) comprising the cylinder (44), the rod (50) of which is to receive a support element (64) of a diameter corresponding to the diameter of the pivot pin (12) or to a diameter of a tubular support element (66) of an internal diameter greater than the diameter of the pivot pin (12), and a second flange (60), comprising a bore (96) of a diameter corresponding to the diameter of the spacer and comprising two dismantleable half-flanges (98, 100) abutting in a plane (102) passing through a diameter of said bore, said bore (96) being to selectively receive a tubular bottom bush (104), the bottom piercing of which is of a diameter corresponding to the diameter of the pivot pin (12), in order to selectively:

extract the pivot pin (12), the rod (50) of the cylinder (44) of the first flange (58) receiving the support element (64) of the diameter corresponding to the diameter of the pivot pin (12) and the second flange (60) occupying a transversal position on the tie rods (94) such that the second flange (60) is assembled around the spacer (28) received in the bush-free bore (96) of said second flange (60), and drive the two external side pieces (30, 32), the two internal side pieces (24, 26) and the spacer onto the pivot pin, the rod (50) of the cylinder (44) receiving the tubular support element (66) of the internal diameter greater the diameter that of the pivot pin (12) intended to bear on the external side piece (32) of the associated link, and the second flange (60) occupying a transversal position on the tie rods (94) such that the flanges (58, 60) are arranged on either side of the side pieces (30, 32) of the external link (14), the bore (96) of the second flange (60) receiving the tubular bottom bush (104) intended to immobilize the pivot pin (12) and the side piece (30) of the external link (14) opposite the cylinder (44).

10. The device according to claim 1, wherein the ducts are fed with hydraulic fluid via a single hydraulic feed element (54).

11. The device (10) according to claim 10, wherein the control device (48) comprises the single hydraulic feed element (54) and a hydraulic distributor (56) to distribute the hydraulic fluid obtained from the single hydraulic feed element (54) between the ducts of the two cylinders (44) to provoke the simultaneous displacement of the two cylinders.

12. The device (10) according to claim 11, wherein the hydraulic distributor (56) comprises two independent manual valves to adjust a flow rate of hydraulic fluid feeding each cylinder (44) to manually synchronize the displacements of the two cylinders (44).

13. The device (10) according to claim 11, wherein the hydraulic distributor (56) is an automatic distributor to automatically synchronize the displacement of the two cylinders (44) in a synchronized manner.

14. The device (10) according to claim 10, wherein the hydraulic feed element (54) comprises an electrically-powered hydraulic plant.

15. The device according to claim 1, wherein, each cylinder support (46) comprises i) a first branch (58) which transversally receives said cylinder (44), and ii) a second branch (60), parallel to the first branch (58), the second branch (60) forming an abutment element opposing movement, in order to extract the pivot pin (12) when the cylinder (44) stresses the pivot pin (12).

* * * * *

UNITED STATES PATENT AND TRADEMARK OFFICE

CERTIFICATE OF CORRECTION

PATENT NO. : 8,544,253 B2
APPLICATION NO. : 13/055268
DATED : October 1, 2013
INVENTOR(S) : Jean Sevrette It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 145 days.

Signed and Sealed this
Fifteenth Day of September, 2015

Michelle K. Lee

Michelle K. Lee
*Director of the United States Patent and Trademark Office*